US011439234B2

(12) United States Patent
Zhang

(10) Patent No.: US 11,439,234 B2
(45) Date of Patent: Sep. 13, 2022

(54) MOVABLE CHAIR MECHANISM, CHAIR FRAME AND CHAIR

(71) Applicant: Xiaozhao Zhang, Chuzhou (CN)

(72) Inventor: Xiaozhao Zhang, Chuzhou (CN)

( * ) Notice: Subject to any disclaimer, the term of this patent is extended or adjusted under 35 U.S.C. 154(b) by 0 days.

(21) Appl. No.: 17/233,442

(22) Filed: Apr. 17, 2021

(65) Prior Publication Data

US 2022/0087423 A1 Mar. 24, 2022

(30) Foreign Application Priority Data

Sep. 24, 2020 (CN) ..... 202022128861.1

(51) Int. Cl.

| | |
|---|---|
| ***A47C 1/034*** | (2006.01) |
| ***A47C 1/02*** | (2006.01) |
| ***A47C 3/02*** | (2006.01) |
| ***A47C 1/032*** | (2006.01) |

(52) U.S. Cl.

CPC ..... *A47C 1/03211* (2013.01)

(58) Field of Classification Search

CPC . A47C 1/03211; A47C 1/03205; A47C 1/032; A47C 1/031; A47C 3/00

See application file for complete search history.

(56) References Cited

U.S. PATENT DOCUMENTS 7,000,988 B2 * 2/2006 Bressler ..... A61G 5/14 297/DIG. 10
7,147,278 B2 * 12/2006 Johnson ..... A47C 1/0352 297/85 R
7,445,279 B2 * 11/2008 Crum ..... A47C 1/0355 297/69
7,641,277 B2 * 1/2010 Lawson ..... A47C 1/0352 297/85 L
8,297,693 B2 * 10/2012 Hoffman ..... A47C 3/0255 297/85 M
8,398,165 B2 * 3/2013 Lawson ..... A47C 3/027 297/259.2
8,449,027 B2 * 5/2013 Wiecek ..... A47C 1/031 297/75
10,299,596 B2 * 5/2019 White ..... A47C 1/0355
10,299,597 B1 * 5/2019 Crum ..... A47C 1/0355
2010/0283297 A1 * 11/2010 Crum ..... A47C 7/50 297/423.28

(Continued)

*Primary Examiner* — Shin H Kim

(57) ABSTRACT

A movable chair mechanism, a chair frame and a chair are provided. The movable chair mechanism includes a chair component, an intermediate transmission component and an installation component. The intermediate transmission component includes three transmission connecting rods. The first transmission connecting rod and the third transmission connecting rod are pivotally connected to the chair component respectively, and ends of the second transmission connecting rod are pivotally connected to the first transmission connecting rod and the third transmission connecting rod respectively. The installation component includes a fixing connecting rod, a first swing arm and a second swing arm. The fixing connecting rod is fixed to a base, ends of the first swing arm are pivotally connected to the first transmission connecting rod and the fixing connecting rod respectively, and ends of the second swing arm are pivotally connected to the third transmission connecting rod and the fixing connecting rod respectively.

20 Claims, 4 Drawing Sheets

(56) References Cited

U.S. PATENT DOCUMENTS

| | | | | |
|---|---|---|---|---|
| 2012/0119547 | A1* | 5/2012 | Hoffman | A47C 3/0255<br>297/84 |
| 2012/0299363 | A1* | 11/2012 | Crum | A47C 1/0352<br>297/85 M |
| 2014/0132038 | A1* | 5/2014 | Lu | A47C 1/035<br>297/68 |
| 2014/0132039 | A1* | 5/2014 | Lu | A61G 15/02<br>297/68 |
| 2016/0029800 | A1* | 2/2016 | Bryant | A47C 1/0242<br>297/284.3 |
| 2022/0071396 | A1* | 3/2022 | Zhang | A47C 7/5068 |
| 2022/0087423 | A1* | 3/2022 | Zhang | A47C 1/03211 |
| 2022/0087431 | A1* | 3/2022 | Zhang | A47C 7/5068 |
| 2022/0125200 | A1* | 4/2022 | Zhang | A47C 1/023 |

* cited by examiner

MOVABLE CHAIR MECHANISM, CHAIR FRAME AND CHAIR

CROSS-REFERENCE TO RELATED APPLICATIONS

This application claims all benefits accruing under 35 U.S.C. § 119 from China Patent Application No. 202022128861.1, filed on Sep. 24, 2020, titled "MOVABLE CHAIR MECHANISM, CHAIR FRAME AND CHAIR" in the China National Intellectual Property Administration, the content of which is hereby incorporated by reference.

TECHNICAL FIELD

The present disclosure generally relates to chairs, and in particular, to a movable chair mechanism, a chair frame and a chair.

BACKGROUND

At present, a chair is provided to adjust the user's sitting posture. Such chair includes a chair frame having a movable chair mechanism, and the movable chair mechanism includes a chair component configured to support and lift the user. The movable chair mechanism can move and drive the chair component to move, thus forming three different states of use which can include sitting, leisure and lying to meet different user needs.

A height position of the chair component can change significantly during the movement of the movable chair mechanism, creating a feeling of up and down instability to the user. While the chair is in the leisure state or lying state, a position of the chair component and a chair support structure of the chair component is higher, which leads to a higher center of gravity center of the user. Any shaking feeling to the user can lead to an unstable and unreliable support of the chair component. It is not easy to lift the user while maintaining good balance.

SUMMARY

Thus, it is desired to provide a movable chair mechanism, a chair frame and a chair.

The present disclosure provides a movable chair mechanism including a chair component, an intermediate transmission component and an installation component. The intermediate transmission component includes a first transmission connecting rod, a second transmission connecting rod and a third transmission connecting rod. The first transmission connecting rod and the third transmission connecting rod are pivotally connected to the chair component, respectively, and ends of the second transmission connecting rod are pivotally connected to the first transmission connecting rod and the third transmission connecting rod, respectively. The installation component includes a fixing connecting rod, a first swing arm and a second swing arm. The fixing connecting rod is fixed to a base, ends of the first swing arm are pivotally connected to the first transmission connecting rod and the fixing connecting rod respectively, and ends of the second swing arm are pivotally connected to the third transmission connecting rod and the fixing connecting rod respectively. The installation component is capable of driving the intermediate transmission component into motion, and the intermediate transmission component is capable of driving the chair component into motion in a first direction.

In an embodiment, the installation component further includes a first connecting rod. A first end of the first connecting rod is pivotally connected to either of the first swing arm and the second swing arm, and a second end of the first connecting rod is pivotally connected to the second transmission connecting rod.

In this way, a connecting rod mechanism composed of the intermediate transmission component and the installation component has a lower degree of freedom, which is conductive to further confirming a motion trajectory of the movable chair mechanism and to avoid a disorderly movement of individual components.

In an embodiment, the first end of the first connecting rod is pivotally connected to the second swing arm, and the first connecting rod, the second transmission connecting rod, the second swing arm and the third transmission connecting rod form a second four-rod mechanism. A pivot point between the first connecting rod and the second swing arm is located at a side of a pivot point between the second swing arm and the second transmission connecting rod away from the fixing connecting rod.

In an embodiment, a pivot point between the first transmission connecting rod and the third transmission connecting rod is located between a pivot point of the first transmission connecting rod and the first swing arm and a pivot point of the first transmission connecting rod and the chair component, and/or a pivot point between the second transmission connecting rod and the third transmission connecting rod is located between a pivot point of the second transmission connecting rod and the second swing arm and a pivot point of the second transmission connecting rod and the chair component.

In this way, a structure of a movable chair frame is more compact, and when the movable chair frame is placed on the ground, the movable chair frame has a smaller displacement in the direction perpendicular to the ground, so that the height change of the chair support structure is smaller during the user's adjustment of the different sitting states, which is conducive to reducing the height change of the gravity center position of the user, improving the stability of the movement of the movable chair frame, and bringing the user a safer and more secure feeling of use.

In an embodiment, the movable chair mechanism further includes a back component. A first end of the back component is pivotally connected to the chair component and a second end of the back component is pivotally connected to the installation component. The back component is capable of being extended or folded relative to the chair component driven by the chair component.

The present disclosure further provides a chair frame including a base and the movable chair mechanism as described above. The movable chair mechanism is fixed to the base by the fixing connecting rod. The chair component includes a first four-rod mechanism, and the first four-rod mechanism includes a chair support structure.

In an embodiment, when the chair frame is placed on the ground, the chair support structure is inclined relative to a direction parallel to the ground.

In this way, when the user sits on the chair, the chair support structure gains the tendency to move upward relative to the ground while extending, thus better lifting the user's legs. When the user ends use of the chair and leaves, the chair support structure retracts while falling relative to the ground and drives the first four-rod mechanism to retract, thus in some embodiments, this feature can be used to achieve automatic reset recovery of the chair component by the gravity of the chair support structure itself.

In an embodiment, the chair frame includes two sets of the movable chair mechanism symmetrically disposed relative to the base and capable of associated moving synchronously.

In this way, the two sets of the movable chair mechanism have better support effect and are more convenient to arrange a skin or other structural parts for supporting the user's body outside the movable chair mechanism, in order to increase the support area and balance for the user.

In an embodiment, the chair support structure includes a chair support portion and a backrest support portion. A backrest angle is defined by the chair support portion and the backrest support portion. The backrest support portion has an extended length in a range of 60 mm to 130 mm, and the chair support portion has an extended length in a range of 350 mm to 500 mm, or the chair support portion has an extended length in a range of 510 mm to 700 mm.

In this way, chair support structures with different lengths can be configured in the chair frame. Chair support structures with a shorter chair support portion can be used in chair frames that are mainly used in a sitting state or a leisure state, while chair support structures with a longer chair support portion can be used in chair frames that are mainly used in a leisure state or a lying state.

In an embodiment, the chair component further includes a first rocker and a second rocker. The first rocker and the second rocker are pivotally connected to the intermediate transmission component respectively and pivotally connected to ends of the chair support structure respectively. A distance between a pivot point of the chair support structure and the first rocker and a pivot point of the chair support structure and the second rocker ranges from 350 mm to 370 mm; or a distance between a pivot point of the chair support structure and the first rocker and a pivot point of the chair support structure and the second rocker ranges from 370 mm to 450 mm.

In this way, when the distance between the pivot point of the chair support structure and the first rocker and the pivot point of the chair support structure and the second rocker is in a smaller range, the overall size of the chair frame is smaller, so the weight of the chair frame is lighter and the chair structure is lighter, which can meet the demand of general sitting or lying state. When the distance between the pivot point of the chair support structure and the first rocker and the pivot point of the chair support structure and the second rocker is in a larger range, the first rocker and the second rocker can swing at the same time, so the degree of influence on the change of the gravity center position of the chair support structure is further reduced, and it is conductive to reducing the height of the center of gravity of the chair support structure to ensure the stability of the user in a leisure state and a lying state.

The present disclosure further provides a chair including the chair frame as described above.

In an embodiment, the chair includes a driving component. The driving component is connected to the base and connected to the movable chair mechanism by transmission, the driving component is configured to drive the chair component to extend or fold and drive the chair component to move in a first direction.

The present disclosure provides the movable chair mechanism. The movable chair mechanism can improve a mechanism connection between the chair component and the base of the chair by the intermediate transmission component and the installation component. It can reduce the amount of position change of the chair component and the chair support structure in the direction perpendicular to the ground when the movable chair mechanism is in motion. This can eliminate the obvious up and down feeling to the user, and also reduce the height of the chair component and its chair support structure in the sitting, leisure and lying states, thereby reducing the height of a center of gravity of the user. It is conductive to solving the problems of swaying of the chair component and lack of stability of the support due to the high gravity center of the user, resulting in ensuring the balance of the chair component.

In the figures, 10 represents an intermediate transmission component; 11 represents a first transmission connecting rod; 12 represents a second transmission connecting rod; 13 represents a third transmission connecting rod; 20 represents an installation component; 21 represents a fixing connecting rod; 22 represents a first swing arm; 23 represents a second swing arm; 24 represents a first connecting rod; 31 represents a first rocker; 32 represents a second rocker; 33 represents a chair support structure; 331 represents a chair support portion; 332 represents a backrest support portion; 34 represents a sliding connecting rod; 41 represents a backrest element; 42 represents a first back connecting rod; 43 represents a second back connecting rod; 44 represents a third back connecting rod; 50 represents a driving component; 51 represents a motor housing; 52 represents a push rod; 60 represents a footrest mechanism; 300 represents a chair.

DETAILED DESCRIPTION OF THE EMBODIMENT

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without departing from the inventive scope are the scope of the present disclosure.

Unless otherwise defined, all technical and scientific terms used herein have the same meaning as a skilled person in the art would understand. The terminology used in the description of the present disclosure is for the purpose of describing particular embodiments and is not intended to limit the disclosure. The term "or/and" as used herein includes any and all combinations of one or more of the associated listed items.

Figure 1:
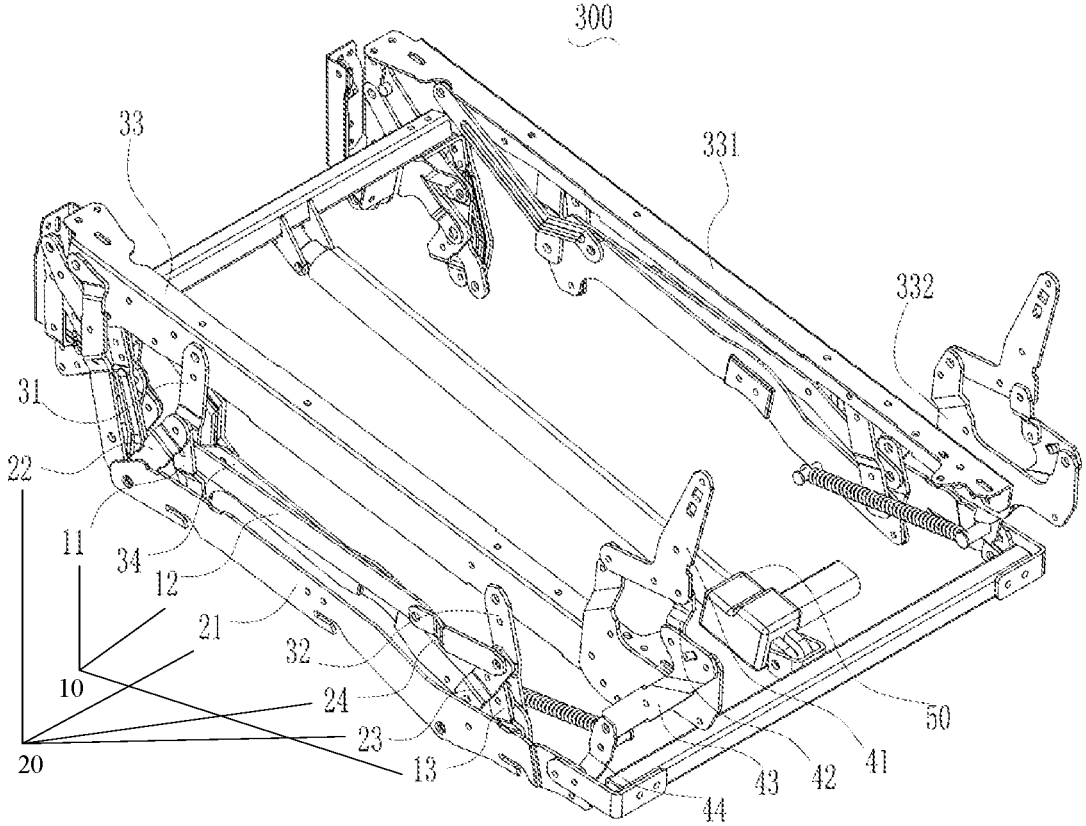
FIG. 1 is a structural schematic view of a chair in a sitting state in an embodiment of the present disclosure.
Figure 2:
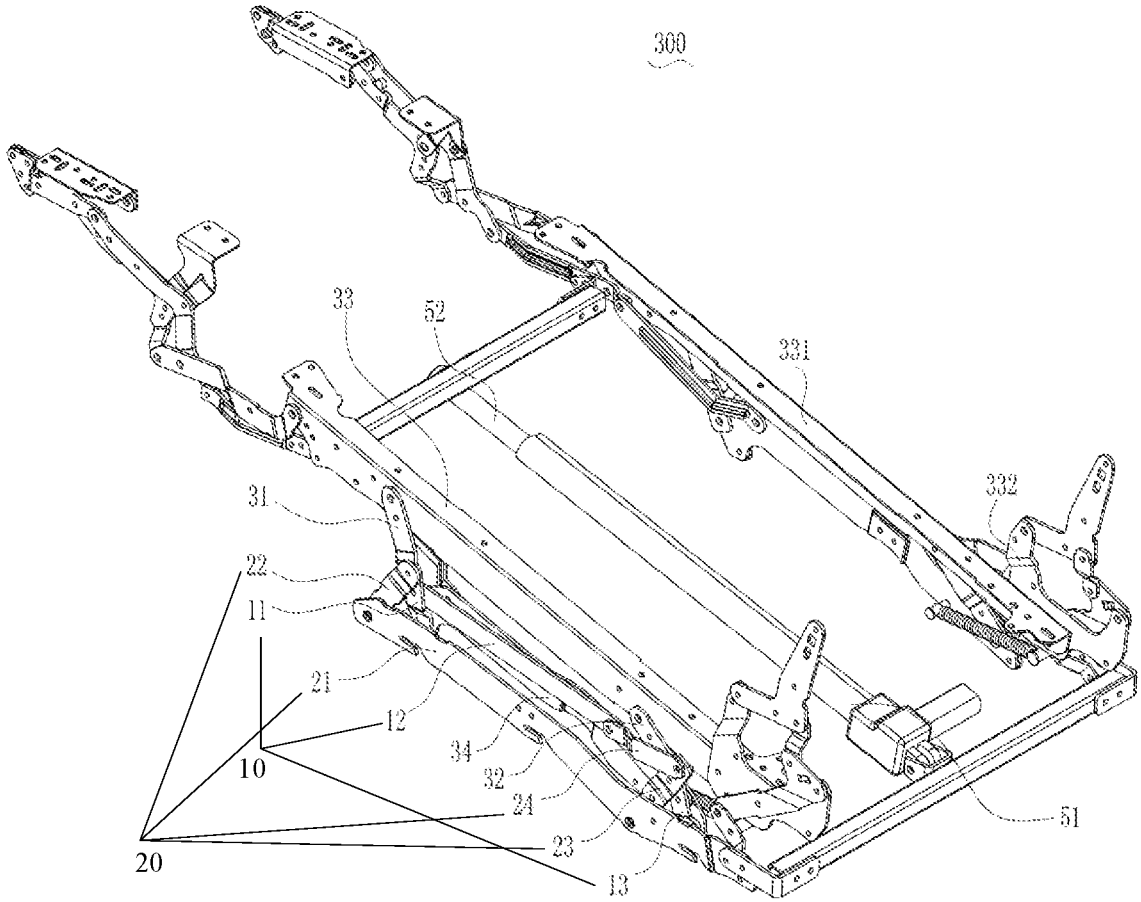
FIG. 2 is a structural schematic view of the chair in a leisure state in an embodiment of the present disclosure.
Figure 3:
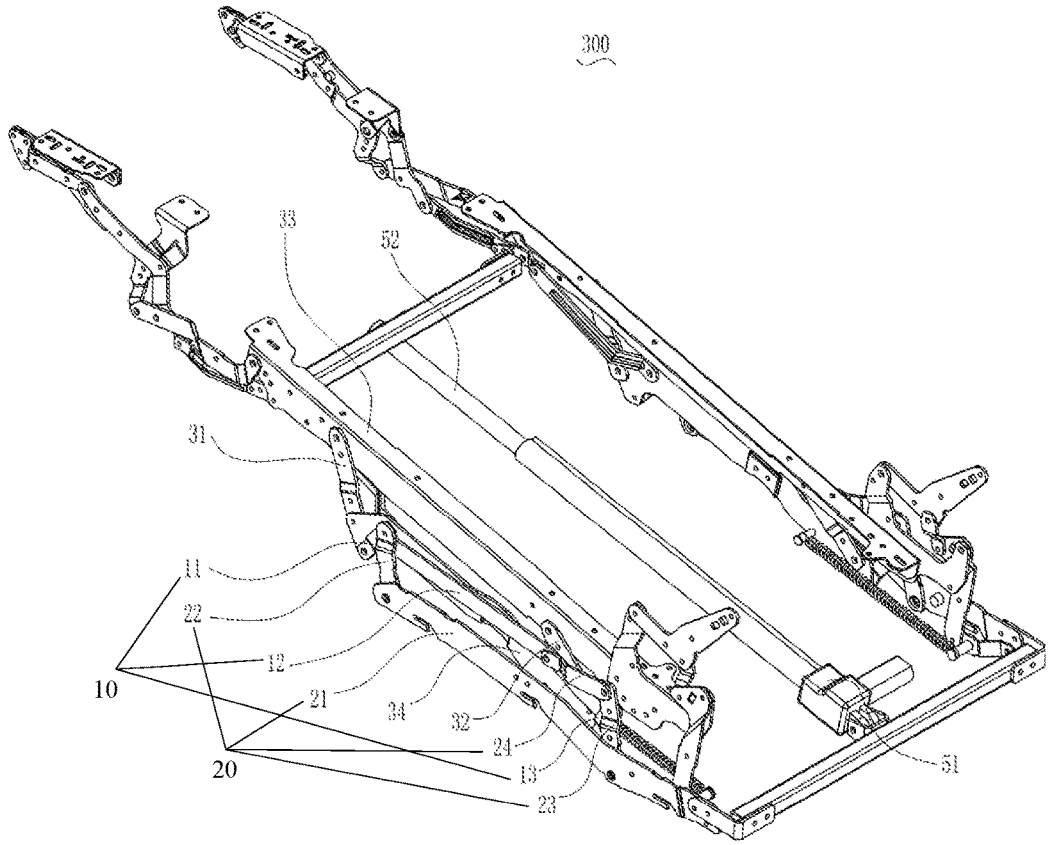
FIG. 3 is a structural schematic view of the chair in a lying state in an embodiment of the present disclosure.
Figure 4:
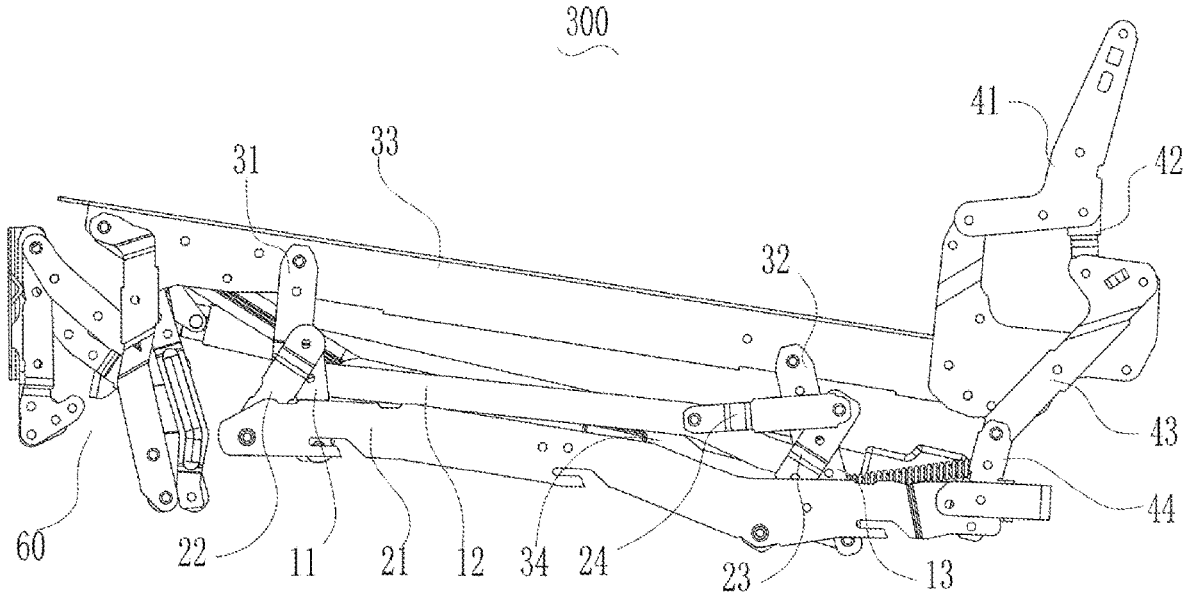
FIG. 4 is a side view of the chair in a sitting state of FIG. 1.
Figure 5:
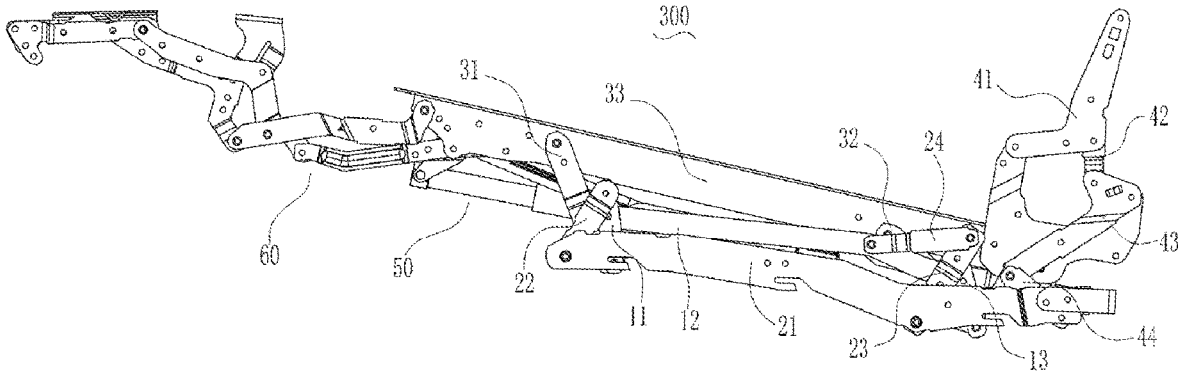
FIG. 5 is a side view of the chair in a leisure state of FIG. 2.
Figure 6:
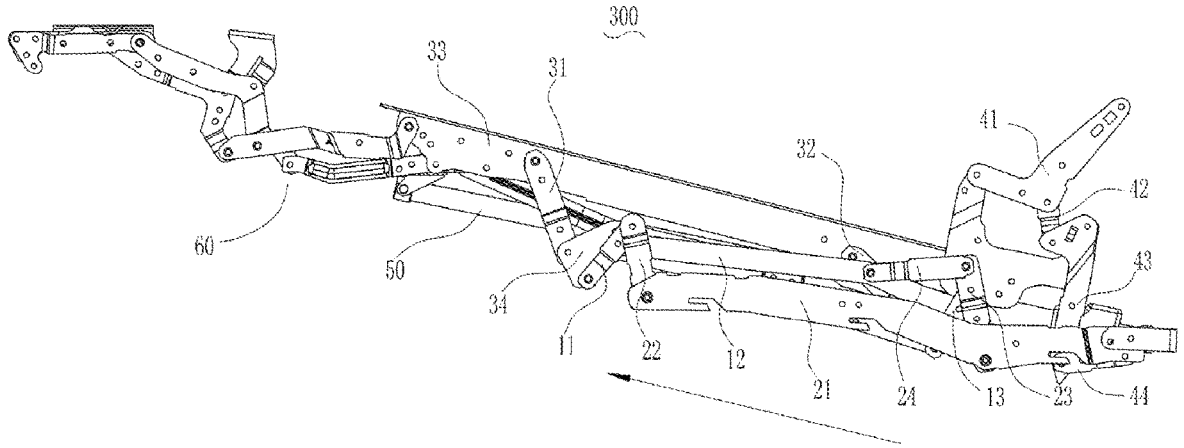
FIG. 6 is a side view of the chair in a lying state of FIG. 3.

FIG. 1 is a structural schematic view of a chair 300 in a sitting state in an embodiment of the present disclosure. FIG. 2 is a structural schematic view of the chair 300 in a leisure state in an embodiment of the present disclosure. FIG. 3 is a structural schematic view of the chair 300 in a lying state in an embodiment of the present disclosure. FIG. 4 is a side view of the chair 300 in a sitting state of FIG. 1. FIG. 5 is a side view of the chair 300 in a leisure state of FIG. 2. FIG. 6 is a side view of the chair 300 in a lying state of FIG. 3.

At present, there is a class of chairs that can adjust a user's sitting posture. The chair can include a chair support and a base. The chair support of the chair can be moved relative to the base of the chair to form three using states of sitting, leisure and lying. The using state of the chair can be changed by a movable chair mechanism. The movable chair mechanism is controlled by the user to move according to a preset trajectory, driving the chair support structure to the front or the rear of the chair, i.e., a direction near or far from the user's feet. In addition, the design of the movable chair mechanism needs to meet the requirements of changes of the height of the center of gravity of the user and the gravity center position of the user during the movement of the chair support structure.

The present disclosure provides a movable chair mechanism, a chair frame and a chair 300. The movable chair mechanism includes a chair component. Specifically, in a embodiment of the present disclosure (hereinafter referred to "the present embodiment"), the chair component may include a chair support structure 33 configured to carry the user and be movable relative to the base (not shown) of the chair 300, a sliding connecting rod 34, a first rocker 31 and a second rocker 32. The sliding connecting rod 34 is configured to connect to the base of the chair 300 and pivotally connected to the first rocker 31 and the second rocker 32, respectively. A first end of the first rocker 31 away from the sliding connecting rod 34 is pivotally connected to the chair support structure 33, and a first end of the second rocker 32 away from the sliding connecting rod 34 is pivotally connected to the chair support structure 33. The chair support structure 33, the first rocker 31, the second rocker 32 and the sliding connecting rod 34 can form a first four-rod mechanism, which generates an extension or folding motion with a defined trajectory through an oscillation of the first rocker 31 and the second rocker 32 relative to the sliding connecting rod 34, and drives the chair support structure 33 to move.

Furthermore, in some embodiments, the chair support structure 33 includes a chair support portion 331 and a backrest support portion 332. The chair support portion 331 is mainly configured to support the user and connected to an intermediate transmission component 10. In the present embodiment, the chair support portion 331 is pivotally connected to the first rocker 31 and the second rocker 32, respectively. The backrest support portion 332 can be used as a mounting base of the back component. In addition, the backrest support portion 332 can also bear the pressure from the user's back. A backrest angle can be formed between the chair support portion 331 and the backrest support portion 332. The backrest support portion 332 has an extended length in a range of 60 mm to 130 mm and the chair support portion 331 has an extended length in a range of 450 mm to 580 mm. Adaptively, a distance between a pivot point of the chair support structure 33 and the first rocker 31 and a pivot point of the chair support structure 33 and the second rocker 32 is in a range of 350 mm to 370 mm.

The chair support structure 33 provided in the above embodiment can be used in a chair frame in a sitting state or a leisure state as a main use scenario, with a lighter weight of the chair component as well as the chair frame and a more lightweight structure of the chair. Thus, the chair support structure 33 can be used as a component part of conventional leisure chair products.

In other embodiments, the chair support structure 33 has a larger length. Specifically, the chair support portion 331 has an extended length in a range of 580 mm to 700 mm. Adaptively, the distance between the pivot point of the chair support structure 33 and the first rocker 31 and the pivot point of the chair support structure 33 and the second rocker 32 is in a range of 370 mm to 450 mm.

In the embodiments, the chair support portion 331 can have a larger length, which can be achieved by lengthening the distance between the pivot point of the chair support portion 331 and the first rocker 31 and the pivot point of the chair support portion 331 and the second rocker 32. The chair support portion 331 can be used in the chair frame with the leisure state or the lying state as the main use scenario. The first rocker 31 and the second rocker 32 can swing with respect to the sliding connecting rod 34 at the same time, further reducing the degree of influence on the change of the gravity center position of the chair support structure 33. Without changing the structures of the first rocker 31, the second rocker 32, and the sliding connecting rod 34 and connection relationships thereof, the height of the center of gravity of the chair support structure 33 can be further reduced to ensure the stability of the user in the leisure state and the lying state, so that it can be used as a component part of a chair product used in deep rest, and the lifting height of the chair can be lowered and the chair has the effect of deepening the seat.

Specifically, compared to the previous embodiment, the lifting height of the chair in this embodiment can be reduced by a distance in a range of 145 mm to 160 mm.

Of course, the chair component is not limited to include the above elements, i.e., the chair component does not only include the first four-rod mechanism, but also may include other mechanisms with more auxiliary functions, such as a footrest mechanism 60, which can be extended or retracted relative to the chair component so as to provide leg support for the user in the lying state.

A height position of the chair component may change in a large amount during the movement of a common movable chair mechanism, creating a feeling of up and down instability to the user. While the chair is in the leisure state or the lying state, a position of the chair component and a chair support structure of the chair component is higher, which leads to a higher center of gravity center of the user. Any of shaking feeling to the user can lead to an un-stable and un-reliable support of the chair component. It is not easy to lift the user while maintaining good balance.

To solve this problem, the movable chair mechanism provided by the present disclosure also includes the intermediate transmission component 10 and an installation component 20. The intermediate transmission component 10 can include a first transmission connecting rod 11, a second transmission connecting rod 12 and a third transmission connecting rod 13. The first transmission connecting rod 11 and the third transmission connecting rod 13 are pivotally connected to the chair component respectively, and ends of the second transmission connecting rod 12 are pivotally connected to the first transmission connecting rod 11 and the third transmission connecting rod 13, respectively. Specifically, in the present embodiment, the first transmission connecting rod 11 the third transmission connecting rod 13 are pivotally connected to the sliding connecting rod 34, respectively. The installation component 20 includes a fixing connecting rod 21, a first swing arm 22 and a second swing arm 23. The fixing connecting rod 21 is fixed to the base of the chair 300, ends of the first swing arm 22 are pivotally connected to the first transmission connecting rod 11 and the fixing connecting rod 21, respectively, and ends of the second swing arm 23 are pivotally connected to the third transmission connecting rod 13 and the fixing connecting rod 21, respectively.

In the present embodiment, moving mechanism of the movable chair mechanism is as following: the installation component 20 is capable of driving the second transmission connecting rod 12 to move through swing of the first swing arm 22 and the second swing arm 23 relative to the fixing connecting rod 21, which in turn drives the intermediate transmission component 10 to move as a whole. In addition, the intermediate transmission component 10 is capable of driving the sliding connecting rod 34 to move via a movement of the first transmission connecting rod 11 and the third transmission connecting rod 13 relative to the second transmission connecting rod 12, which in turn drives the overall chair component to move in the first direction.

Referring to FIG. 6 again, the first direction is defined as a direction of the fixing connecting rod 21 parallel to its rod length and pointing toward the user's feet, i.e., a direction of the arrow shown in FIG. 6. The chair support structure 33 produces a translational motion or an approximately translational motion along the same direction as the rod length of the fixing connecting rod 21. The chair support structure 33 can extend in the first direction when the user sits on the chair 300 and retract again in the reverse of the first direction when the user finishes using the chair 300.

Taking an example of the chair support structure 33 extending in the first direction, when the first swing arm 22 and the second swing arm 23 rotate in the same direction relative to the fixing connecting rod 21, and a first end of the first swing arm 22 and a first end of the second swing arm 23 away from the fixing connecting rod 21 will move closer to the front side of the chair 300 where the user's foot is located, the first transmission connecting rod 11 and the third transmission connecting rod 13 are also driven to move in the first direction, which in turn causes the second transmission connecting rod 12 to move in the first direction. At the same time, the second transmission connecting rod 12 can control the first transmission connecting rod 11 and the third transmission connecting rod 13. The first transmission connecting rod 11 and the third transmission connecting rod 13 jointly drive the sliding connecting rod 34 to move in the first direction at the same time, so that the first four-rod mechanism will move as a whole in the first direction. In other words, a displacement of the first four-rod mechanism as a whole moving in the first direction corresponds to a sum of the movement of the first swing arm 22 and the second swing arm 23, the first transmission connecting rod 11 and the third transmission connecting rod 13 in the first direction.

The present disclosure provides the movable chair mechanism. The movable chair mechanism can improve a mechanism connection between the chair component and the base of the chair 300 by the intermediate transmission component 10 and the installation component 20. It can reduce an amount of position change of the chair component and the chair support structure 33 in the direction perpendicular to the ground when the movable chair mechanism is in motion. This can eliminate the obvious up and down feeling to the user, and also reduce the height of the chair component and its chair support structure 33 in the sitting, leisure and lying states, thereby reducing the height of the center of gravity of the user. It is conductive to solving the problems of swaying of the chair component and lack of stability of the support due to the high gravity center of the user, and ensuring the balance of the chair component.

Furthermore, in an embodiment, the installation component 20 further includes a first connecting rod 24. A first end of the first connecting rod 24 is pivotally connected to either of the first swing arm 22 and the second swing arm 23, and a second end of the first connecting rod 24 is pivotally connected to the second transmission connecting rod 12.

Specifically, in the present embodiment, the ends of the first connecting rod 24 are pivotally connected to the second swing arm 23 and the second transmission connecting rod 12, respectively. In the specific application, the second swing arm 23 is near the rear side of the chair 300, the first swing arm 22 is relatively near the front side of the chair 300, and the first connecting rod 24, the second transmission connecting rod 12, the second swing arm 23 and the third transmission connecting rod 13 will form a second four-rod mechanism. In addition, a pivot point between the first connecting rod 24 and the second swing arm 23 is located at a side of a pivot point between the second swing arm 23 and the second transmission connecting rod 12 away from the fixing connecting rod 21.

In this way, a connecting rod mechanism composed of the intermediate transmission component 10 and the installation component 20 can have a lower degree of freedom, which is conductive to further confirming of a motion trajectory of the movable chair mechanism and avoiding a disorderly movement of individual components.

Furthermore, a pivot point between the first transmission connecting rod 11 and the third transmission connecting rod 13 can be located between a pivot point of the first transmission connecting rod 11 and the first swing arm 22 and a pivot point of the first transmission connecting rod 11 and the sliding connecting rod 34. Alternatively, a pivot point between the second transmission connecting rod 12 and the third transmission connecting rod 13 is located between a pivot point of the second transmission connecting rod 12 and the second swing arm 23 and a pivot point of the second transmission connecting rod 12 and the sliding connecting rod 34.

In this way, a structure of a movable frame of the chair 300 is more compact, and when the movable frame of the chair 300 is placed on the ground, the movable frame of the chair 300 has a smaller displacement in the direction perpendicular to the ground, so that the height change of the chair support structure 33 is smaller during the user's adjustment of different sitting states, which is conducive to reducing the height change of the center of gravity of the user, improving the stability of the movement of the movable frame of the chair 300, and bringing the user a safer and more secure feeling of use.

Furthermore, in an embodiment, the movable frame of the chair 300 further includes a back component. A first end of the back component is pivotally connected to the chair component and a second end of the back component is pivotally connected to the installation component 20. The back component is capable of being extended or folded relative to the chair component driven by the chair component. In the present embodiment, the back component can include a backrest element 41, a first back connecting rod 42, a second back connecting rod 43 and a third back connecting rod 44. The backrest element 41 is pivotally connected to the chair support structure 33 to support the user's back and waist. The ends of the first back connecting rod 42 are pivotally connected to the backrest element 41 and the second back connecting rod 43, respectively, and the ends of the third back connecting rod 44 are pivotally connected to the second back connecting rod 43 and the fixing connecting rod 21, respectively. During the state change of the movable chair mechanism from the sitting state, the leisure state to the lying state, the chair support structure 33 and the backrest element 41 are rotated and expanded relative to each other, and the angle between the chair support structure 33 and the backrest element 41 increases, i.e., the backrest angle increases.

Furthermore, in the chair frame provided by the present disclosure, when the chair frame is placed on the ground, the chair support structure 33 is inclined relative to a direction parallel to the ground, i.e., the chair support structure 33 has a inclined angle relative to the plane in which the ground is located.

Specifically, in the present embodiment, when the chair support structure 33 is placed on the ground, the chair support structure 33 is inclined relative to a direction parallel to the ground, the inclined state of the chair support structure 33 relative to the ground includes: the chair support structure 33 is relatively close to a first end of the user's leg, i.e., the height of the chair support structure 33 at the front end of the movable chair mechanism is higher than the height of the chair support structure 33 at the rear end of the movable chair mechanism, which is relatively far from the user's leg. In the present embodiment, the inclined angle of the chair support structure 33 relative to ground is in a range of 5° to 15°.

In this way, when the user sits on the chair 300, the chair support structure 33 tends to move upward relative to the ground while extending, thus lifting the user's legs up better. When the user leaves the chair, the chair support structure 33 retracts while moving down relative to the ground and drives the first four-rod mechanism to retract. That is, in some embodiments, it can achieve automatic reset recovery of the chair component by the gravity of the chair support structure 33 itself.

Furthermore, in the present embodiment, the chair frame can include two sets of the movable chair mechanism symmetrically disposed relative to the base and capable of associated moving synchronously. The two sets of the movable chair mechanism have better support effect and are more convenient to arrange a skin or other structural parts for supporting the user's body outside the movable chair mechanism, in order to increase the support area and balance of the user.

Furthermore, the chair provided in the present disclosure further includes a driving component 50. The driving component 50 is connected to the base and connected to the movable chair mechanism by transmission, the driving component is configured to drive the chair component to extend or fold and drive the chair component to move in the first direction. In the present embodiment, the driving component 50 includes a pusher motor pivotally connected to the base. The pusher motor includes a motor housing 51 and a push rod 52 disposed in the motor housing 51. The motor housing 51 is pivotally connected to the base through a U-shaped seat, the push rod 52 telescopically penetrates into the motor housing 51, and the end of the push rod 52 is connected to the chair component by transmission. When the chair component is in a folded state, it corresponds to an idle state and a sitting state of the chair 300. The pusher motor starts to control the elongation of the push rod 52, and at the same time drives the chair component to gradually extend, so that the chair 300 gradually changes to the leisure state or the lying state. The electric control driving method of the pusher motor achieves the sitting state adjustment of the chair 300 more convenient and labor-saving, and the adjustment process is safer.

The present disclosure provides the movable chair mechanism. The movable chair mechanism can improve a mechanism connection between the chair component and the base of the chair 300 by the intermediate transmission component 10 and the installation component 20. It can reduce the amount of position change of the chair component and the chair support structure 33 in the direction perpendicular to the ground where the chair is when the movable chair mechanism is in motion. This can eliminate the obvious up and down feeling to the user, and also reduce the height of the chair component and its chair support structure 33 in the sitting, leisure and lying states, thereby reducing the height of the center of gravity of the user. It is conductive to solving the problems of swaying of the chair component and lack of stability of the support due to the high gravity center of the user, and ensuring the balance of the chair component.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. A movable chair mechanism, comprising a chair component, an intermediate transmission component and an installation component, wherein the intermediate transmission component comprises a first transmission connecting rod, a second transmission connecting rod and a third transmission connecting rod, the first transmission connecting rod and the third transmission connecting rod are pivotally connected to the chair component, respectively, and ends of the second transmission connecting rod are pivotally connected to the first transmission connecting rod and the third transmission connecting rod, respectively;

the installation component comprises a fixing connecting rod, a first swing arm and a second swing arm, the fixing connecting rod is fixed to a base, ends of the first swing arm are pivotally connected to the first transmission connecting rod and the third transmission connecting rod, respectively, and ends of the second swing arm are pivotally connected to the third transmission connecting rod and the fixing connecting rod, respectively;

the installation component is capable of driving the intermediate transmission component into motion, and the intermediate transmission component is capable of driving the chair component into motion in a first direction.

2. The movable chair mechanism of claim 1, wherein the installation component further comprises a first connecting rod, a first end of the first connecting rod is pivotally connected to either the first swing arm or the second swing arm, and a second end of the first connecting rod is pivotally connected to the second transmission connecting rod.

3. The movable chair mechanism of claim 2, wherein the first end of the first connecting rod is pivotally connected to the second swing arm; the first connecting rod, the second transmission connecting rod, the second swing arm and the third transmission connecting rod form a second four-rod mechanism; a pivot point between the first connecting rod and the second swing arm is located at a side of a pivot point between the second swing arm and the second transmission connecting rod away from the fixing connecting rod.

4. The movable chair mechanism of claim 1, wherein a pivot point between the first transmission connecting rod and the third transmission connecting rod is located between a pivot point of the first transmission connecting rod and the first swing arm and a pivot point of the first transmission connecting rod and the chair component; and/or a pivot point between the second transmission connecting rod and the third transmission connecting rod is located between a pivot point of the second transmission connecting rod and the second swing arm and a pivot point of the second transmission connecting rod and the chair component.

5. The movable chair mechanism of claim 1, further comprising a back component, wherein a first end of the back component is pivotally connected to the chair component and a second end of the back component is pivotally connected to the installation component; and the back component is capable of being extended or folded relative to the chair component driven by the chair component.

6. A chair frame, comprising a base and the movable chair mechanism of claim 1, wherein the movable chair mechanism is fixed to the base by the fixing connecting rod, the chair component comprises a first four-rod mechanism, and the first four-rod mechanism comprises a chair support structure.

7. The chair frame of claim 6, wherein the installation component further comprises a first connecting rod, a first end of the first connecting rod is pivotally connected to either the first swing arm or the second swing arm, and a second end of the first connecting rod is pivotally connected to the second transmission connecting rod.

8. The chair frame of claim 7, wherein the first end of the first connecting rod is pivotally connected to the second swing arm; the first connecting rod, the second transmission connecting rod, the second swing arm and the third transmission connecting rod form a second four-rod mechanism; a pivot point between the first connecting rod and the second swing arm is located at a side of a pivot point between the second swing arm and the second transmission connecting rod away from the fixing connecting rod.

9. The chair frame of claim 6, wherein a pivot point between the first transmission connecting rod and the third transmission connecting rod is located between a pivot point of the first transmission connecting rod and the first swing arm and a pivot point of the first transmission connecting rod and the chair component; and/or a pivot point between the second transmission connecting rod and the third transmission connecting rod is located between a pivot point of the second transmission connecting rod and the second swing arm and a pivot point of the second transmission connecting rod and the chair component.

10. The chair frame of claim 6, further comprising a back component, wherein a first end of the back component is pivotally connected to the chair component and a second end of the back component is pivotally connected to the installation component; and the back component is capable of being extended or folded relative to the chair component driven by the chair component.

11. The chair frame of claim 6, wherein when the chair frame is placed on the ground, the chair support structure is inclined relative to a direction parallel to the ground.

12. The chair frame of claim 6, wherein the chair frame comprises two sets of the movable chair mechanism symmetrically disposed relative to the base and capable of associated moving synchronously.

13. The chair frame of claim 6, wherein the chair support structure comprises a chair support portion and a backrest support portion, a backrest angle is defined by the chair support portion and the backrest support portion;

the backrest support portion has an extended length in a range of 60 mm to 130 mm, and the chair support portion has an extended length in a range of 450 mm to 580 mm; or, the chair support portion has an extended length in a range of 580 mm to 700 mm.

14. The chair frame of claim 9, wherein the chair component further comprises a first rocker and a second rocker, the first rocker and the second rocker are pivotally connected to the intermediate transmission component, respectively, and pivotally connected to ends of the chair support structure, respectively;

a distance between a pivot point of the chair support structure and the first rocker and a pivot point of the chair support structure and the second rocker ranges from 350 mm to 370 mm; or a distance between a pivot point of the chair support structure and the first rocker and a pivot point of the chair support structure and the second rocker ranges from 370 mm to 450 mm.

15. A chair, wherein the chair comprises the chair frame of claim 6.

16. The chair of claim 15, wherein the chair comprises a driving component, the driving component is connected to the base, and connected to the movable chair mechanism by transmission, the driving component is configured to drive the chair component to extend or fold and drive the chair component to move in a first direction.

17. The chair of claim 15, wherein the installation component further comprises a first connecting rod, a first end of the first connecting rod is pivotally connected to either the first swing arm or the second swing arm, and a second end of the first connecting rod is pivotally connected to the second transmission connecting rod.

18. The chair of claim 17, wherein the first end of the first connecting rod is pivotally connected to the second swing arm; the first connecting rod, the second transmission connecting rod, the second swing arm and the third transmission connecting rod form a second four-rod mechanism; a pivot point between the first connecting rod and the second swing arm is located at a side of a pivot point between the second swing arm and the second transmission connecting rod away from the fixing connecting rod.

19. The chair of claim 15, wherein a pivot point between the first transmission connecting rod and the third transmission connecting rod is located between a pivot point between the first transmission connecting rod and the first swing arm and a pivot point between the first transmission connecting rod and the chair component; and/or a pivot point between the second transmission connecting rod and the third transmission connecting rod is located between a pivot point of the second transmission connecting rod and the second swing arm and a pivot point of the second transmission connecting rod and the chair component.

20. The chair frame of claim 15, further comprising a back component, wherein one end of the back component is pivotally connected to the chair component and the other end of the back component is pivotally connected to the installation component; and the back component is capable of being extended or folded relative to the chair component driven by the chair component.

* * * * *